US006868942B2

(12) United States Patent
Barzilai et al.

(10) Patent No.: US 6,868,942 B2
(45) Date of Patent: Mar. 22, 2005

(54) EMERGENCY ESCAPE SYSTEM

(75) Inventors: Yoav Barzilai, Ashkelon (IL); Rafi Salhov, Ashkelon (IL)

(73) Assignee: Double Exit Ltd., Ashkelon (IL)

( * ) Notice: Subject to any disclaimer, the term of this patent is extended or adjusted under 35 U.S.C. 154(b) by 0 days.

(21) Appl. No.: 10/383,618

(22) Filed: Mar. 10, 2003

(65) Prior Publication Data

US 2004/0045771 A1 Mar. 11, 2004

Related U.S. Application Data

(63) Continuation-in-part of application No. 10/237,034, filed on Sep. 9, 2002.

(51) Int. Cl.[7] ..... E06C 9/00; A62B 1/06; A62B 1/10

(52) U.S. Cl. ..... 182/77; 182/239; 182/70

(58) Field of Search ..... 182/73, 70, 71, 182/72, 74, 75, 142, 76, 84, 77; 188/65.1–65.4, 890

(56) References Cited

U.S. PATENT DOCUMENTS

| | | | | | |
|---|---|---|---|---|---|
| 2,709,030 | A | * | 5/1955 | Vroman et al. | 182/78 |
| 3,844,377 | A | * | 10/1974 | Wilkins | 182/6 |
| 4,934,484 | A | * | 6/1990 | Green et al. | 182/72 |
| 5,064,021 | A | * | 11/1991 | Bauer | 182/73 |
| 5,277,271 | A | * | 1/1994 | Lemay | 182/73 |
| 5,467,841 | A | * | 11/1995 | Krumal | 182/70 |
| 5,785,147 | A | * | 7/1998 | Lee | 182/70 |
| 6,771,181 | B1 | * | 8/2004 | Hughen, Jr. | 182/76 |

* cited by examiner

*Primary Examiner*—Hugh B. Thompson, II
(74) *Attorney, Agent, or Firm*—Mark M. Friedman

(57) ABSTRACT

An emergency escape system includes an escape apparatus and a door. The escape apparatus is connected to the door. The escape apparatus includes a cord and a release mechanism. The release mechanism is configured to provide a controlled lowering of a person being lowered on the cord.

24 Claims, 9 Drawing Sheets

EMERGENCY ESCAPE SYSTEM

This application is a continuation-in-part of co-pending U.S. application Ser. No. 10/237,034 filed on 9 Sep. 2002.

FIELD AND BACKGROUND OF THE INVENTION

The present invention relates to an emergency escape system and, in particular, it concerns the storage of an automatic escape apparatus within a door.

By way of introduction, escape devices for allowing an individual to descend from a building generally require that the escape device is securely installed into an exterior or interior wall of the building, for example, internal and external chutes and rope based devices.

Internal devices such as internal chutes generally need to be installed as the building is being erected. Therefore these devices cannot easily be installed in existing buildings.

External devices, such as external chutes and rope-based devices, are typically installed above or near a window or balcony. There are several problems with this method of installation. First, not all walls are suitable for this installation, thereby restricting the positioning of the device. Second, this type of installation is expensive. Third, the escape device housing is visible. Fourth, if the device is installed on an interior wall, the device occupies valuable wall space. Fifth, the device is installed locally and is not typically usable from another window in the building. Sixth, most systems require professional assistance to install and/or deploy and/or use the device, thereby wasting valuable escape time. Seventh, many devices do not allow evacuation from very high buildings. Eighth, many devices cannot be operated in high-risk environments containing fire, smoke or gases.

Rope based devices are additionally restricted by the release mechanism used to provide a controlled release of the rope. Prior art release mechanisms do not have fail-safe devices should any problems occur.

There is therefore a need for an automatic escape system that is easily and cheaply installed in a variety of locations including new and existing buildings, provides compact and concealed storage for the automatic escape apparatus, is available for use from all the emergency exits of a building. There is also a need for a reliable fail safe release mechanism to provide a controlled release of a rope.

SUMMARY OF THE INVENTION

The present invention is an automatic emergency escape system and method of operation thereof.

According to the teachings of the present invention there is provided, an emergency escape system comprising: (a) an escape apparatus; and (b) a door, wherein the escape apparatus is connected to the door during storage and use of the escape apparatus.

According to a further feature of the present invention, there is also provided a storage container which is mechanically connected to the door, the storage container being configured to house a majority of the escape apparatus during storage of the escape apparatus.

According to a further feature of the present invention, the door is configured for fitting in a building using at least one hinge such that, when fitted in the building, the door is able to swing horizontally.

According to a further feature of the present invention, the door is reinforced.

According to a further feature of the present invention, the escape apparatus includes a cord.

According to a further feature of the present invention, the escape apparatus includes a storage arrangement configured to store the cord.

According to a further feature of the present invention, the storage arrangement includes a spool.

According to a further feature of the present invention, the storage arrangement includes at least one holder configured to connect the cord to the door, the at least one holder being sufficiently strong that the cord is maintained connected to the door when the cord is not in use and when the cord is needed, the cord is easily released from the door.

According to a further feature of the present invention, the cord is inflammable.

According to a further feature of the present invention, the escape apparatus includes a release mechanism which is configured to provide a controlled lowering of a person being lowered on the cord.

According to a further feature of the present invention, the release mechanism includes a first controller arrangement configured to apply a braking force as a function of the speed of movement of the cord to limit the speed of movement of the cord to a first speed.

According to a further feature of the present invention, the first controller arrangement is a centrifugal controller device.

According to a further feature of the present invention, the release mechanism includes a fail safe locking device being configured to stop movement of the cord when the speed of the cord exceeds a second speed being greater than the first speed.

According to a further feature of the present invention, the release mechanism includes a second controller arrangement configured to apply a substantial braking force as a function of a force applied by the person to the cord.

According to a further feature of the present invention, the second controller arrangement is configured to apply the substantial braking force as a function of the force applied by the person to the cord when the force applied to the cord exceeds a minimum value.

According to a further feature of the present invention, the second controller arrangement includes at least two grip surfaces, the grip surfaces being configured to apply the braking force to at least part of the cord.

According to a further feature of the present invention, the second controller arrangement includes a lever arrangement mechanically interacting with the cord, the lever arrangement being configured to actuate the grip surfaces to apply the substantial braking force to at least part of the cord.

According to a further feature of the present invention, the escape apparatus includes at least one harness, the harness being configured for connection to the cord.

According to a further feature of the present invention, the escape apparatus is configured for a substantially continuous multiple use during a single evacuation.

According to the teachings of the present invention there is also provided a system for controlling movement of a cord having a force applied thereon, comprising: (a) a first controller arrangement configured to apply a braking force as a function of the speed of movement of the cord; and (b) a second controller arrangement configured to apply a substantial braking force as a function of the force applied to the cord.

According to a further feature of the present invention, the first controller arrangement is a centrifugal controller device.

According to a further feature of the present invention, the first controller arrangement is configured to limit the speed of movement of the cord to a first speed.

According to a further feature of the present invention, there is also provided a fail safe locking device being configured to stop movement of the cord when the speed of the cord exceeds a second speed being greater than the first speed.

According to a further feature of the present invention, the second controller arrangement is configured to apply the substantial braking force as a function of the force applied to the cord when the force applied on the cord exceeds a minimum value.

According to a further feature of the present invention, the second controller arrangement includes at least two grip surfaces, the grip surfaces being configured to apply the substantial braking force to at least part of the cord.

According to a further feature of the present invention, the second controller arrangement includes a lever arrangement mechanically interacting with the cord, the lever arrangement being configured to actuate the grip surfaces to apply the substantial braking force to at least part of the cord.

According to the teachings of the present invention there is also provided a system for controlling movement of a cord having a force applied thereon, comprising: (a) a first controller arrangement configured to apply a braking force as a function of the speed of movement of the cord to limit the speed of movement of the cord to a first speed; and (b) a fail safe locking device being configured to stop movement of the cord when the speed of the cord exceeds a second speed being greater than the first speed.

According to a further feature of the present invention, the first controller arrangement is a centrifugal controller device.

According to the teachings of the present invention there is also provided a system for controlling movement of a cord having a force applied thereon, comprising: (a) a controller arrangement configured to apply a substantial braking force as a function of the force applied to the cord; and (b) a fail safe locking device being configured to stop movement of the cord when the speed of the cord exceeds a speed.

According to a further feature of the present invention, the controller arrangement is configured to apply the substantial braking force as a function of the force applied to the cord when the force applied on the cord exceeds a minimum value.

According to a further feature of the present invention, the controller arrangement includes at least two grip surfaces, the grip surfaces being configured to apply the substantial braking force to at least part of the cord.

According to a further feature of the present invention, the controller arrangement includes a lever arrangement mechanically interacting with the cord, the lever arrangement being configured to actuate the grip surfaces to apply the substantial braking force to at least part of the cord.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is an automatic emergency escape system and method of operation thereof.

The principles and operation of an automatic emergency escape system according to the present invention may be better understood with reference to the drawings and the accompanying description.

Figure 1:
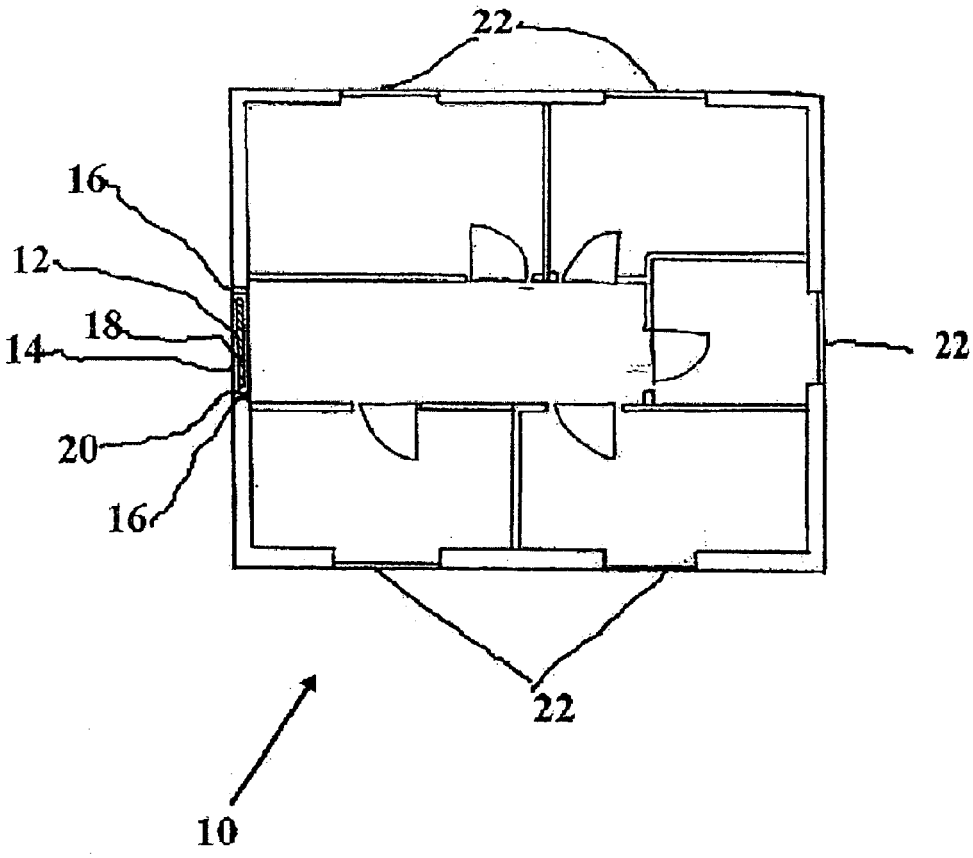
FIG. 1 is schematic plan view of an apartment which has an emergency escape system installed therein that is constructed and operable in accordance with a preferred embodiment of the invention.

Reference is now made to FIG. 1, which is schematic plan view of a apartment 10 which has an emergency escape system 12 installed therein that is constructed and operable in accordance with a preferred embodiment of the invention. By way of introduction, most offices, houses, or apartments have at least one door 14, which is installed in a reinforced doorway 16. In a most preferred embodiment of the present invention, door 14 is also reinforced. Typically, when door 14 is fitted in reinforced doorway 16, door 14 is designed to resist very high forces, which are impacting on door 14. Reinforced doorway 16 is typically formed by a reinforced metal frame. Therefore, installing an automatic escape apparatus 18 within door 14 is advantageous for several reasons. First, automatic escape apparatus 18 is capable of being easily and securely fitted in to door 14, as will be explained below. Moreover, door 14 can be sold with automatic escape apparatus 18 already installed therein, thereby reducing on site installation, as automatic escape apparatus 18 can be installed by any one who can install a normal door in reinforced doorway 16. Second, door 14 is securely fitted into reinforced doorway 16 via at least two hinges 20 at the side of door 14. Therefore, door 14 acts as a central anchoring point for installing automatic escape apparatus 18 therein. Nevertheless, door 14 operates like a conventional secure door and is able to swing horizontally. Third, automatic escape apparatus 18 which is installed in door 14, is quickly available for use at a plurality of openings or windows 22, by passing a cord 44 of automatic escape apparatus 18 to any one of openings or windows 22. Automatic escape apparatus 18 is configured so that automatic escape apparatus 18 is long enough to reach all openings or windows 22. If there are several locations where door 14 can be installed, then the location which is the most central to all emergency escape exits is preferable. Moreover, escape apparatus 18 is very reliable as it is easily released from door 14 and escape apparatus 18 allows for quick escape from a building, as will be described below with respect to FIG. 4. Fourth, automatic escape apparatus 18 is concealed by door 14 when automatic escape apparatus 18 is not in use. Fifth, automatic escape apparatus 18 is stored within door 14, thereby automatic escape apparatus 18 does not take away from usable space within a building. It should also be noted that door 14 has the same depth as a standard secure door, the depth being approximately 4 cm or more.

It will be appreciate by those skilled in the art, that many of the above advantages are realized where escape apparatus 18 is simply mechanically connected to door 14 both during storage and use of escape apparatus 18, even if escape apparatus 18 is not stored within the internal volume of door 14. By way of a first example, housing at least a majority of escape apparatus 18 within a storage container which is mechanically connected to door 14. By way of a second example, mechanically connecting escape apparatus 18 to the surface of door 14 without using a cover to conceal escape apparatus 18 when it is not in use.

It will also be appreciated by those skilled in the art that the term "door" includes a swinging or sliding barrier by which an entry or an emergency exit is closed and opened. An "emergency exit" includes a door, window, hatch or other opening which can be used as an emergency exit from a structure, even though the emergency exit is not generally used as an entry way for non-emergency situations. For example, but not limited to, a steel window shutter which is configured to shield a window. The steel window shutter is generally securely connected to the building such that the steel window shutter provides a very suitable base for mounting escape apparatus 18 thereon, with or without a concealing container or cover.

Figure 2:
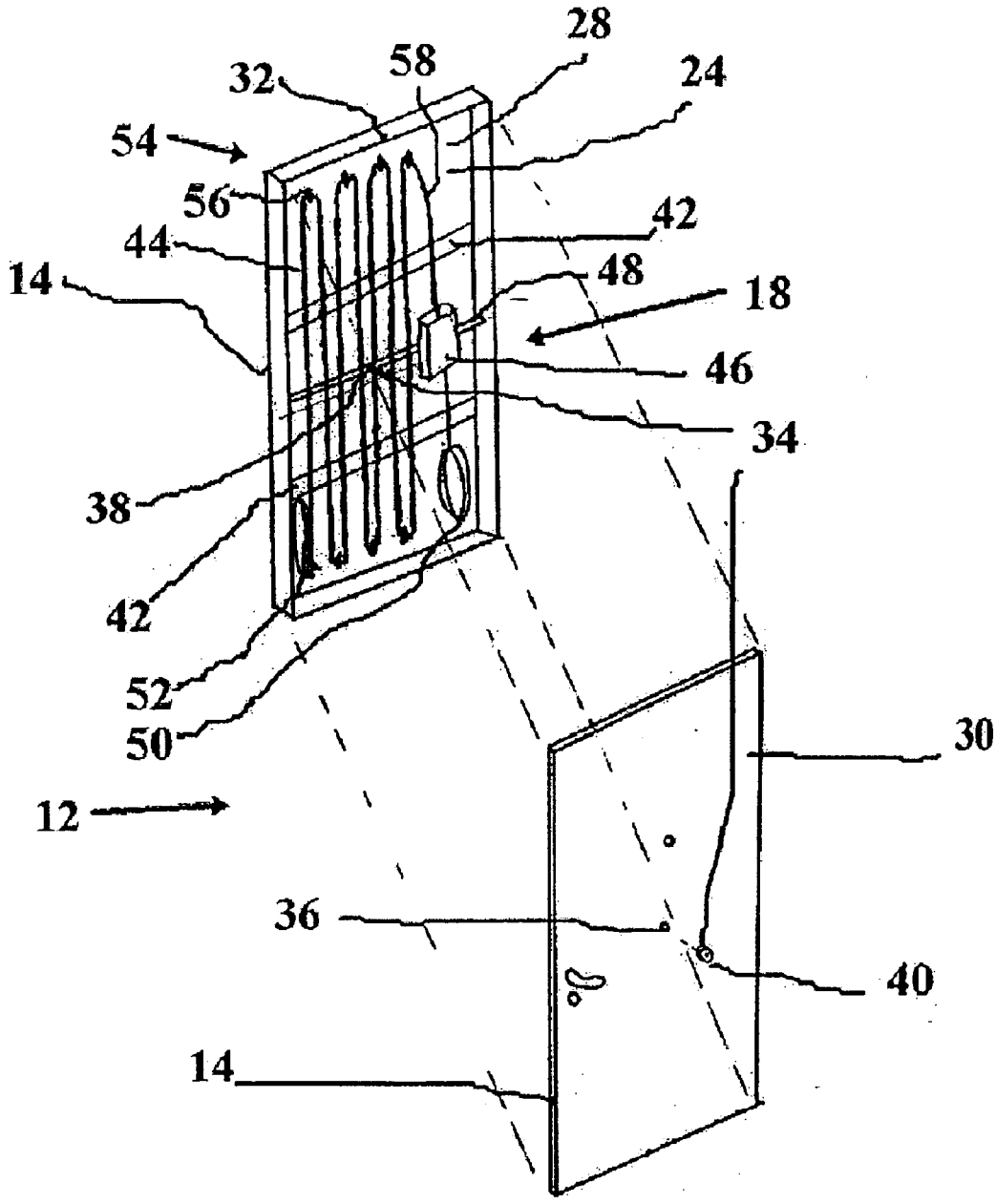
FIG. 2 is an exploded schematic orthogonal view of the emergency escape system of FIG. 1.

Reference is now made to FIG. 2, which is an exploded schematic orthogonal view of emergency escape system 12. Emergency escape system 12 includes automatic escape apparatus 18 and door 14, which is hollow. Door 14 has an internal volume 24. Automatic escape apparatus 18 is wholly storable within internal volume 24. Therefore, automatic escape apparatus 18 is concealed within door 14. Door 14 has a major panel 28 and a major panel 30 and a plurality of side panels 32. Major panel 28 and major panel 30 are typically formed from metal sheet. Side panels 32 are mechanically connected to the edges of major panel 28 such that side panels 32 are substantially perpendicular to major panel 28. Side panels 32 are typically welded to major panel 28. Alternatively, side panels 32 and major panel 28 are formed as a unitary member. Major panel 28 and major panel 30 are substantially planar. It should be noted that major panel 28 and major panel 30 have been described as substantially planar in that a majority of major panel 28 and a majority of major panel 30 are planar. Major panel 28 and major panel 30 are substantially parallel when door 14 is assembled. Major panel 30 or at least part of major panel 30 is configured to be removable from a remainder of door 14 in order to allow access to automatic escape apparatus 18. Door 14 includes a securing arrangement 34, which is configured to allow removal of major panel 30, or at least part of major panel 30 from the remainder of door 14 with a simple and fast action. Securing arrangement 34 is typically includes a bolt 38 and a securing member 40. One end of bolt 38 is welded to the interior of door 14 so that the direction of elongation of bolt 38 is perpendicular to major panel 28. Major panel 30 is secured to the remainder of door 14 by passing the other non-welded end of bolt 38 through a hole 36 in door 14 and then fastening securing member 40 on bolt 38. Therefore, major panel 30 is released from the remainder of door 14 by removing securing member 40 from bolt 38. It will be apparent to those skilled in the art that securing arrangement 34 can be constructed in various forms. By way of a first example, securing arrangement 34 can be implemented as a lever operated mechanism whereby turning a lever releases major panel 30 from the remainder of door 14. By way of a second example, securing arrangement 34 can be implemented as a heat sensitive device whereby major panel 30 is automatically released from door 14 when major panel 28 exceeds a predetermined temperature. Door 14 is typically reinforced by a plurality of reinforcing bars 42. Reinforcing bars 42 are typically formed from steel. Reinforcing bars 42 are mechanically connected, typically by welding or bolting, to major panel 28 and side panels 32. It will be apparent to those skilled in the art that door 14 can be constructed in various ways to provide a hollow door with an internal volume for storing automatic escape apparatus 18 therein. Automatic escape apparatus 18 includes cord 44, a release mechanism 46 and two harnesses 50, 52. The diameter of cord 44 is typically within the range of 8 mm to 12 mm. Cord 44 is typically formed from a woven cable which includes metal strands. However, cord 44 could be a rope, cable, chain or any other equivalent lowering means. Cord 44 is generally inflammable. Release mechanism 46 is configured to provide a controlled lowering of a person who is being lowered on cord 44. The rate of lowering by release mechanism 46 is typically in the range of 1 meter per second and 5 meters per second. The optimal rate of lowering by release mechanism 46 is typically in the range of 2 meters per second to 2.5 meters per second. The rate of lowering is fixed and does not depend upon the weight of the person being lowered by release mechanism 46. Release mechanism 46 is designed to adjust according to the weight of the person being lowered on cord 44. The rate of lowering of release mechanism 46 is typically set by the manufacturer and not by the operator. Release mechanism 46 is automatically reversible. In other words, release mechanism 46 is configured to automatically control the rate of lowering in whichever direction cord 44 is pulled. Release mechanism 46 has a depth which is small enough to allow release mechanism 46 to fit within internal volume 24 of door 14. Release mechanism 46 is described in more detail with reference to FIGS. 5 to 8. Release mechanism 46 is typically bolted or welded to a metal bar 48 which is secured in door 14. The ends of bar 48 are typically welded to side panels 32. Cord 44 is fed through release mechanism 46. Harness 50 is connected to one end of cord 44 and harness 52 is connected to the other end of cord 44. Emergency escape system 12 includes a storage arrangement 54 which is configured to store cord 44 within internal volume 24 of door 14. Storage arrangement 54 is configured to store cord 44 compactly when not in use. In accordance with a most preferred embodiment of the present invention, cord 44 is arranged in a single layer 58 against major panel 28 of door 14 by running cord 44 up and down major panel 28. Cord 44 is then mechanically connected to major panel 28 by one or more holders 56 which are applied at points where cord 44 is bent at the top and bottom of single layer 58. It should be noted that holders 56 may or may not be mechanically connected to cord 44. In other words, holders 56 can be configured to form a loop which is connected to major panel 28 in which cord 44 is held. Holders 56 are sufficiently strong that cord 44 is maintained connected to major panel 28 of door 14 when cord 44 is not in use, however, when cord 44 is needed, cord 44 is easily released from major panel 28 of door 14. Holders 56 are typically formed from soft plastic, rubber or silicon or any elastic plastic material. It should be noted that if necessary, for example when emergency escape system 12 is used in a very large and/or high building, cord 44 is arranged in multiple layers to accommodate a longer cord inside door 14. It will be apparent to those skilled in the art that door 14 can be configured to store various types of escape apparatus that are known in the art, for example, door 14 can be configured to store abseiling equipment or a rope ladder. Optionally, door 14 can be installed with a smoke detector, heat detector to provide an early warning system for people in the building. Additionally, to prevent overheating of release mechanism 46 from a fire on the other side of major panel 28 of door 14, a layer of insulating material (not shown) is typically disposed between major panel 28 of door 14 and release mechanism 46.

Figure 3:
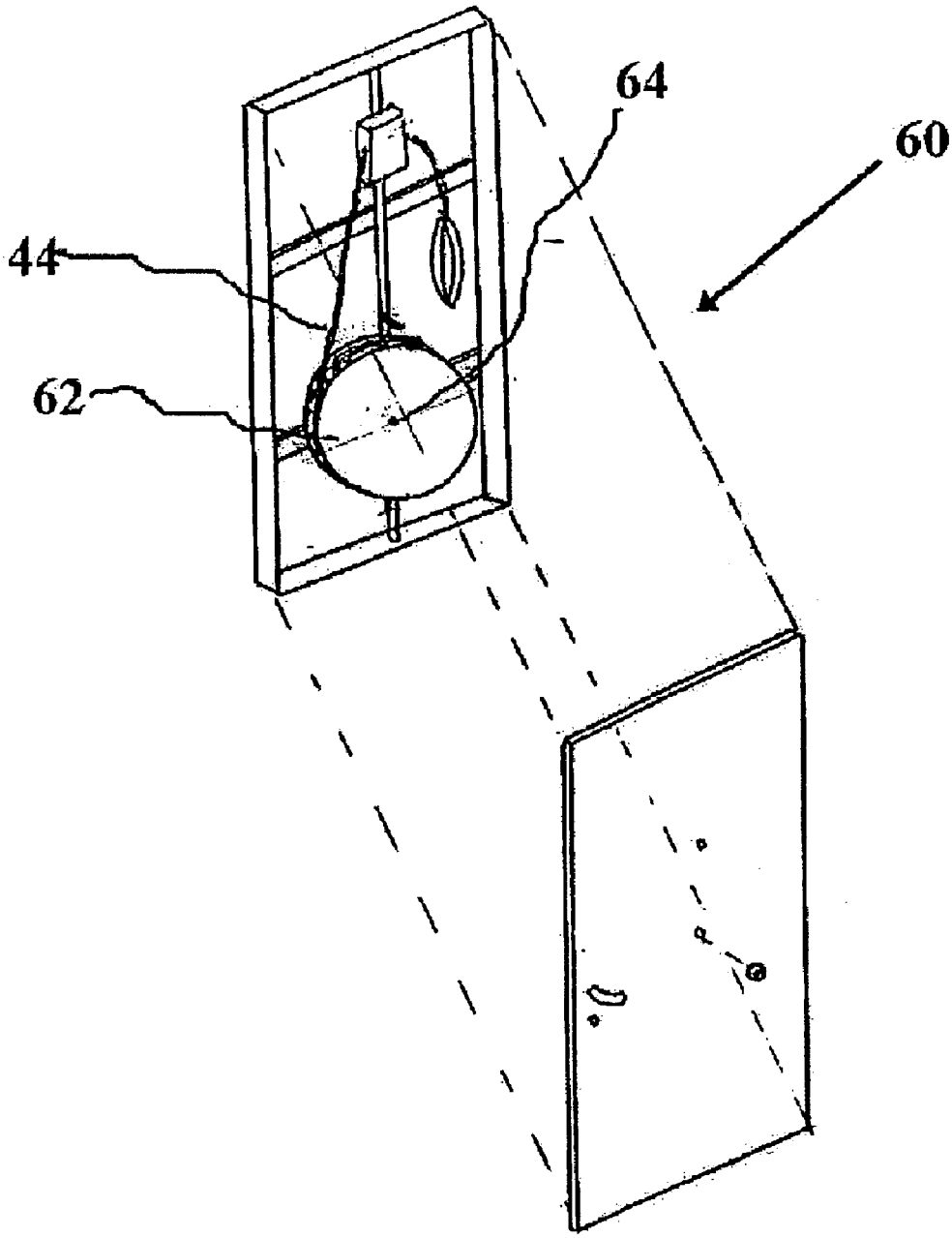
FIG. 3 is an exploded schematic orthogonal view of an emergency escape system that is constructed and operable in accordance with an alternate embodiment of the invention.

Reference is now made to FIG. 3, which is an exploded schematic orthogonal view of an emergency escape system 60 that is constructed and operable in accordance with an alternate embodiment of the invention. Emergency escape system 60 is the same as emergency escape system 12, except that the storage arrangement of emergency escape system includes a spool 62 instead of holders 56. Cord 44 is wound on spool 62 when not in use. Spool 62 has an axis of rotation 64. Spool 62 is typically connected to bar 48 by welding so that spool 62 can rotate about axis of rotation 64.

Figure 4:
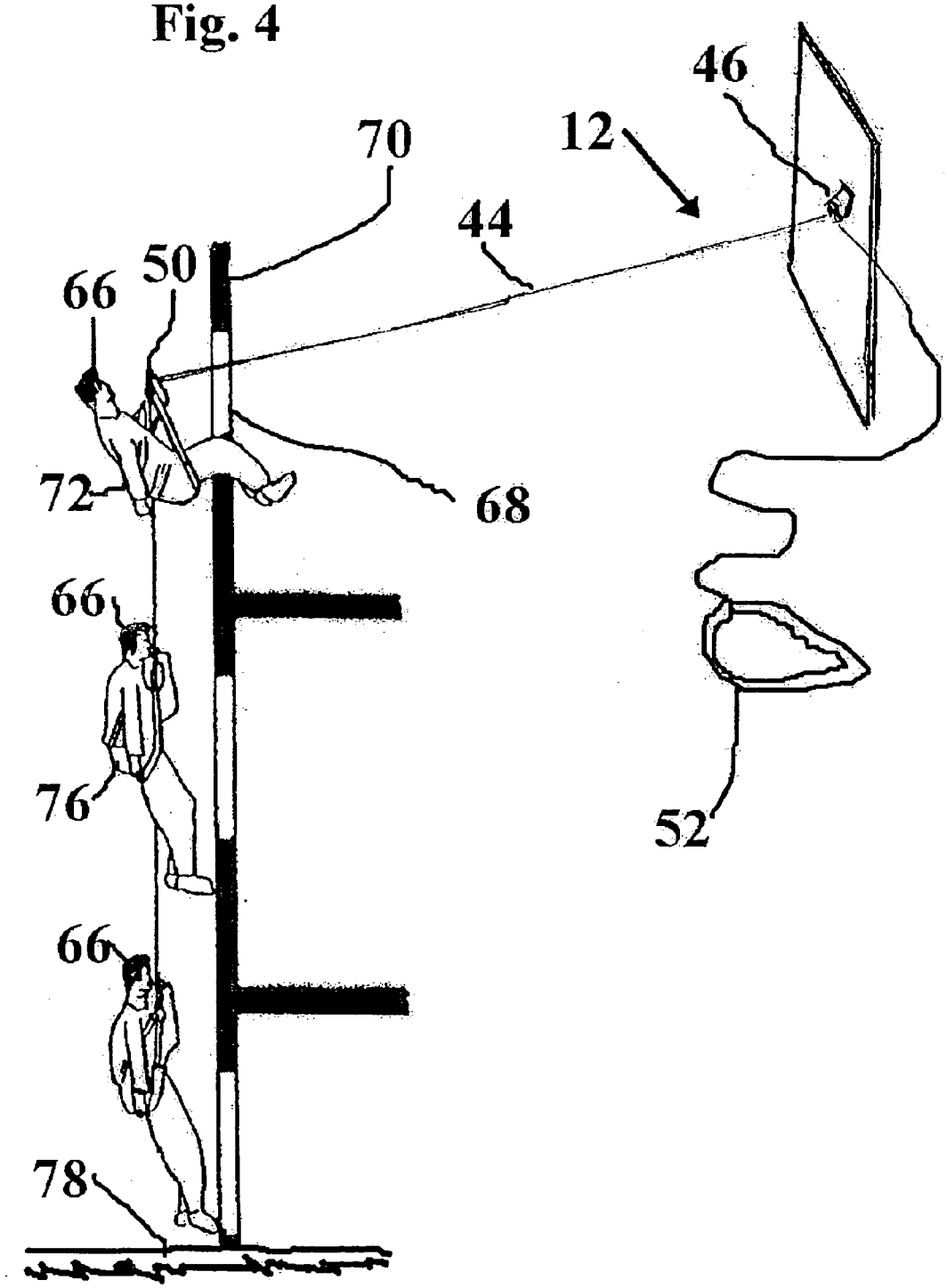
FIG. 4 is a schematic view of an evacuation of a building using the emergency escape system of FIG. 1.

Reference is now made to FIG. 4, which is a schematic view of an evacuation of a building 70 using emergency escape system 12. The following description describes how three people escape from building 70 using emergency escape system 12. A first person to escape, a person 66, wears harness 50. Any slack in cord 44 between person 66 and release mechanism 46 is removed by pulling on the side of the cord having harness 52. Person 66 then exits from a window 68 of building 70 at a position 72. Person 66 is lowered in harness 50 by release mechanism 46 slowly releasing cord 44. Person 66 is lowered in a controlled manner, via a position 76 to the ground at a position 78. A second person (not shown) to escape from building 70, wears harness 52 and evacuates from building 70 in the same way as person 66. When this second person who is wearing harness 52 is lowered from building 70, harness 50 moves towards release mechanism 46. Therefore, a third person (not shown) to escape from building 70 wears harness 50 and evacuates from building 70 in the same way as the previous two people. Therefore, emergency escape system 12 is configured for a substantially continuous multiple use during a single evacuation.

Figure 5:
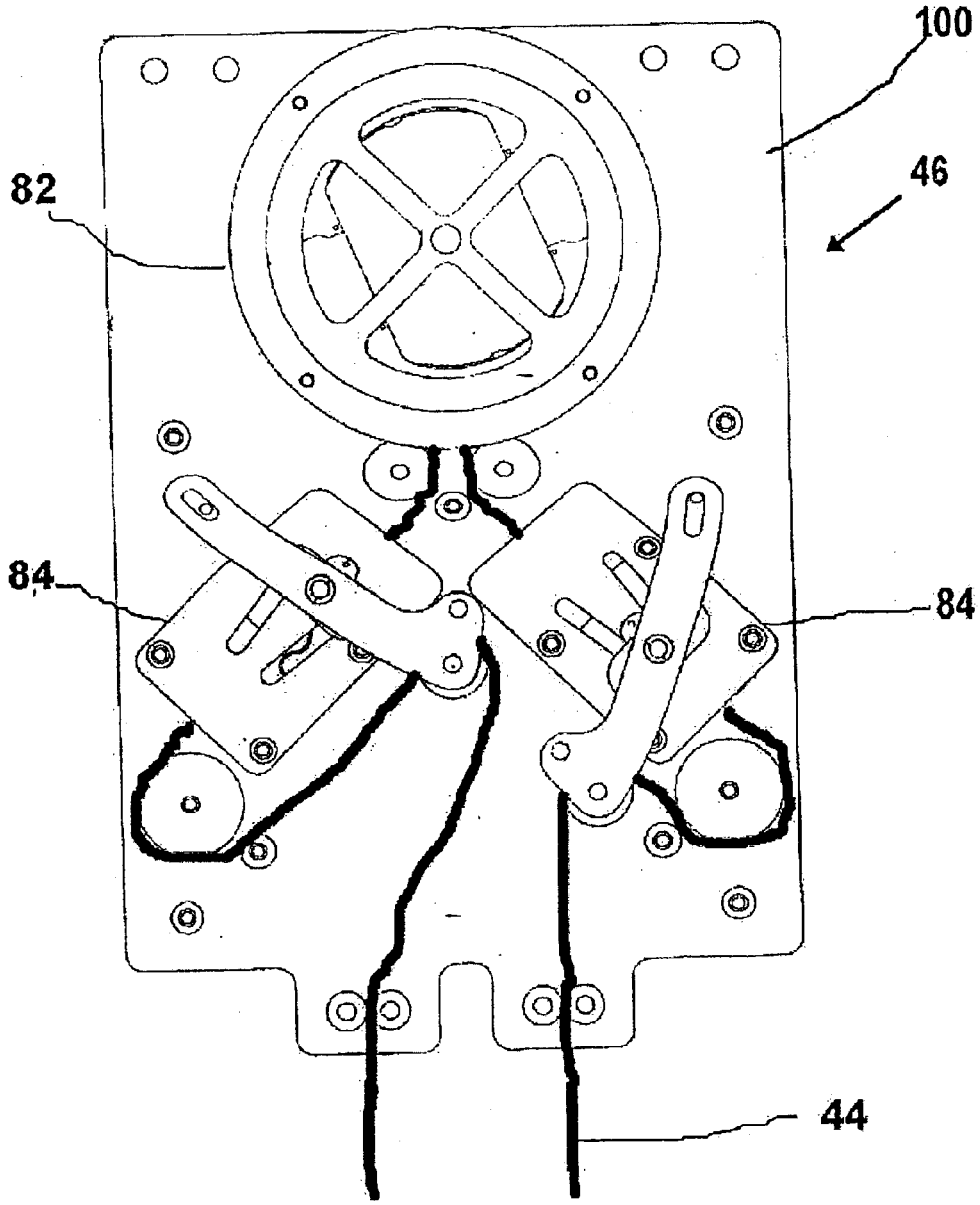
FIG. 5 is a plan view of a release mechanism of the emergency escape system of FIG. 2 that is constructed and operable in accordance with a preferred embodiment of the present invention.

Reference is now made to FIG. 5, which is a plan view of release mechanism 46 of emergency escape system 12 of FIG. 1 that is constructed and operable in accordance with a preferred embodiment of the present invention. Release mechanism 46 includes a controller arrangement 82 and two controller arrangements 84 which are mounted on a lower housing 100. Cord 44 is fed through controller arrangement 82 and each of controller arrangements 84, such that cord 44 is first fed through one of controller arrangement 84 and then through controller arrangement 82 and then through the other of controller arrangement 84. The Controller arrangement 82 is configured to apply a braking force as a function of the speed of movement of cord 44 to limit the speed of movement of cord 44 to a first speed, typically 1 to 2 meters per second. Controller arrangement 82 is configured to operate independently of which end of cord 44 the load is attached to. Controller arrangement 82 is generally configured for operation up to a maximum load being applied to cord 44 of approximately 75 kilograms from a height of 90 meters. When the load on cord 44 exceeds these maximum values, controller arrangement 82 may not operate effectively and may even fail. Controller arrangement 82 is described in more detail with respect to FIG. 6. Therefore, each controller arrangement 84 is configured to apply a braking force as a function of the force applied to cord 44 by the person being lowered on cord 44. This is to ensure that the force exerted by cord 44 on controller arrangement 82 is maintained below the maximum load requirement for controller arrangement 82. The combination of controller arrangement 82 and controller arrangement 84 enables release mechanism 46 to typically provide a controlled lowering of a load up to 150 kilogram from a height of 500 meters at 1 meter per second. When a person is being lowered on one end of cord 44, controller arrangement 84 which is disposed between controller arrangement 82 and that end of cord 44 is configured to apply a braking force as a function of the force applied to cord 44. The other controller arrangement 84 does not apply a substantial braking force. Controller arrangement 84 is described in more detail with reference to FIGS. 7 and 8.

Figure 6:
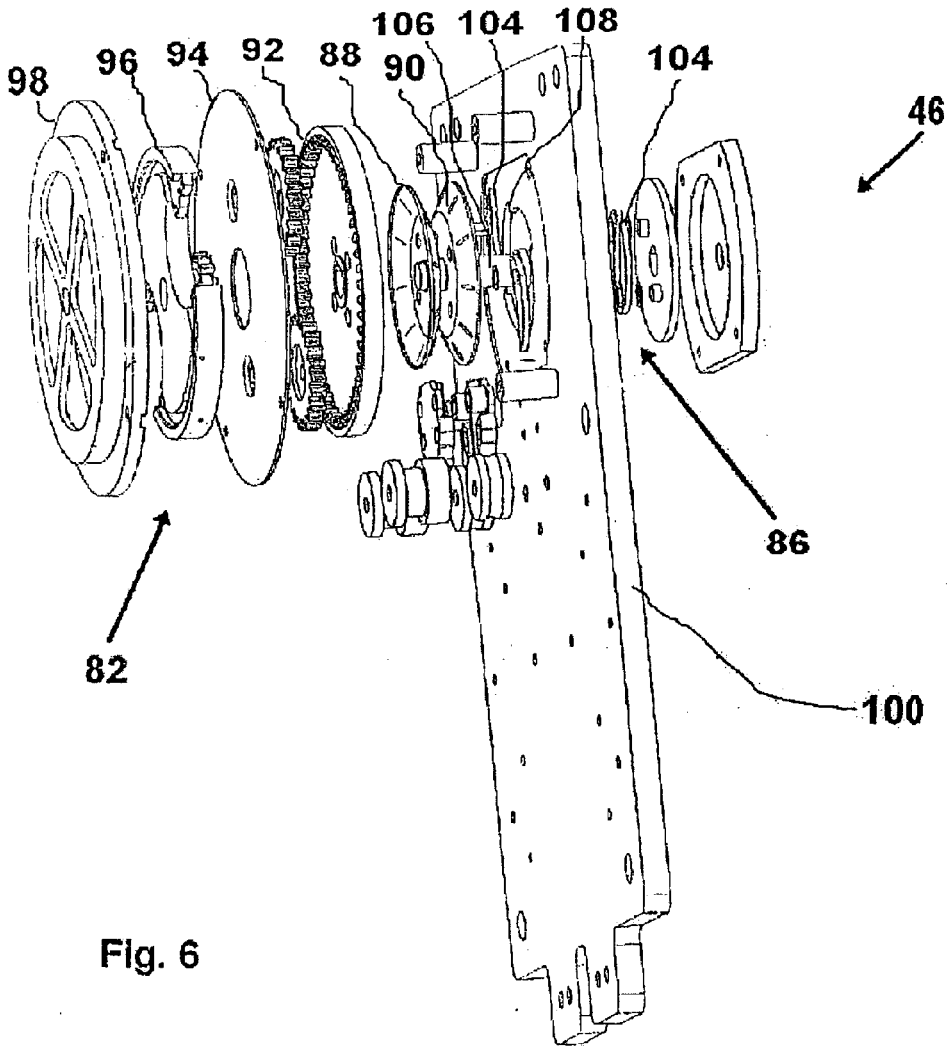
FIG. 6 is an exploded view of a first controller arrangement having a failsafe locking device of the release mechanism of FIG. 5.

Reference is now made to FIG. 6, which is an exploded view of controller arrangement 82 having a fail-safe locking device 86 of release mechanism 46. Controller arrangement 82 is a centrifugal controller device. Controller arrangement 82 has a pulley 88. Cord 44 (not shown) partially circumscribes pulley 88. Pulley 88 has gripping teeth 90 which prevent cord 44 slipping. Controller arrangement 82 also includes a gear arrangement 92, a mounting plate 94, an expanding brake shoe 96 and a top housing 98. Pulley 88, gear arrangement 92, mounting plate 94, expanding brake shoe 96 and top housing 98 are substantially co-axially disposed. Top housing 98 is fixed to lower housing 100. Pulley 88 is mechanically connected to gear arrangement 92. Gear arrangement 92 transfers and steps-up the rotational motion of pulley 88 to mounting plate 94. Mounting plate 94 is mechanically connected to expanding brake shoe 96. Expanding brake shoe 96 is configured to expand as the rotational speed of mounting plate 94 increases such that, expanding brake shoe 96 makes contact with top housing 98 when the rotational speed of mounting plate 94 exceeds a known value, thereby causing pulley 88 to slow down. Therefore, controller arrangement 82 ensures that the speed of movement of cord 44 does not exceed a first speed, typically one meter per second.

Release mechanism 46 also includes fail safe locking device 86 being configured to stop movement of cord 44 when the speed of cord 44 exceeds a second speed being greater than the first speed. The second speed is typically 4 meters per second. Fail-safe locking device 86 works in a similar manner to an inertial seatbelt. Fail-safe locking device 86 has four spring-loaded arms 104, which are mechanically connected to pulley 88 by an axle 106. The free ends of spring loaded arms 104 move away from axle 106 as the speed of movement of cord 44 increases. Once the speed of movement of cord 44 exceeds the second speed, spring-loaded arms 104 engage with notches 108 in lower housing 100 thereby stopping rotational movement of pulley 88 and movement of cord 44. Fail-safe locking device 86 is released by pulling on the end of cord 44 which was not previously descending.

Figure 7:
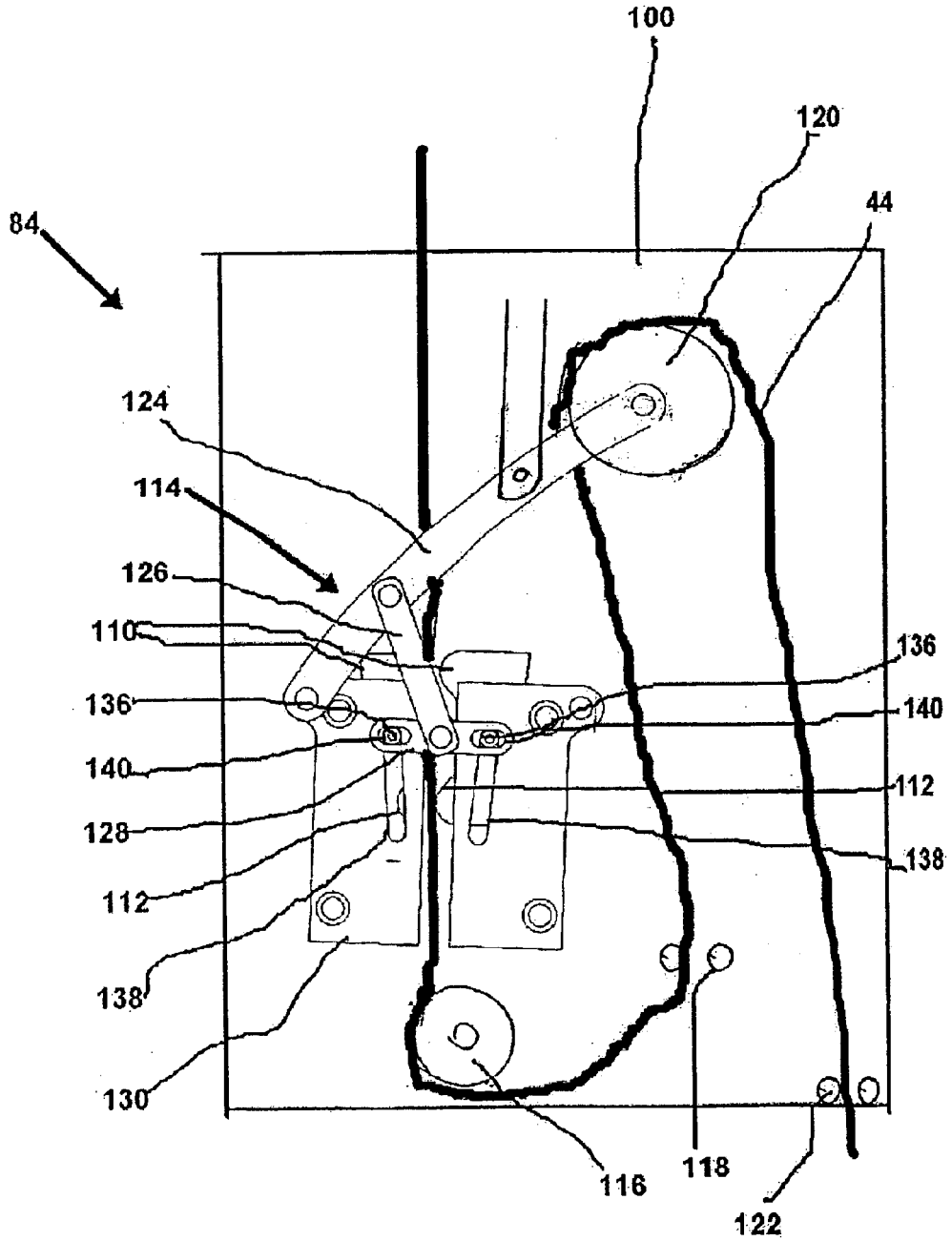
FIG. 7 is a schematic plan view of a second controller arrangement of the release mechanism of FIG. 5.
Figure 8:
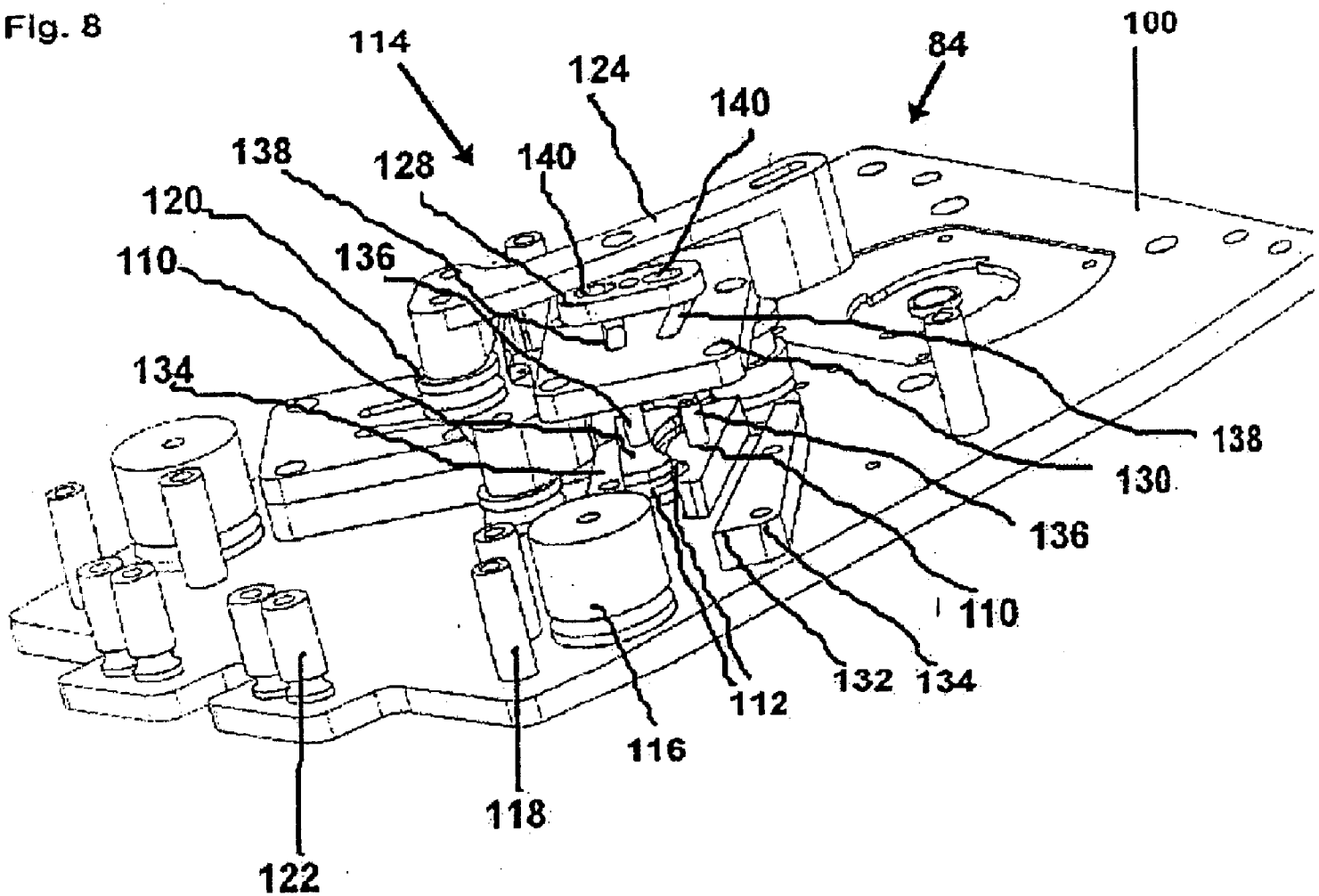
FIG. 8 is an exploded view of the controller arrangement of FIG. 7.

Reference is now made to FIGS. 7 and 8. FIG. 7 is a schematic plan view of controller arrangement 84 of release mechanism 46. FIG. 8 is an exploded view of controller arrangement 84 of FIG. 7. Controller arrangement 84 includes two gripping members 110 having grip surfaces 112 and a lever arrangement 114. Cord 44 (shown in FIG. 7) is fed through controller arrangement 84 between grip surfaces 112. Cord 44 then partially circumscribes a pulley 116. Pulley 116 is mechanically connected to lower housing 100. Cord 44 is then passed between a pair of rollers 118. Rollers 118 are mechanically connected to lower housing 100 by axles. Cord 44 then partially circumscribes a pulley 120 which is mechanically connected to lever arrangement 114. Cord 44 is then passed between a pair of rollers 122. Cord 44 then extends out of release mechanism 46. Lever arrangement 114 mechanically interacts with cord 44 via pulley 120, such that cord 44 pulls down pulley 120 which actuates lever arrangement 114. Lever arrangement 114 then actuates grip surfaces 112 of gripping members 110 to apply a substantial braking force to the part of cord 44 which is disposed between grip surfaces 112. Pulley 120 is used to reduce friction between cord 44 and lever arrangement 114. Additionally, lever arrangement 114 is sprung such that, controller arrangement 84 only applies the substantial braking force as a function of the force applied to an end of cord 44 when the force applied to cord 44 exceeds a minimum value. In other words, when the force applied to cord 44 exceeds the minimum value, cord 44 is able to pull down pulley 120 which actuates lever arrangement 114. Typically, the minimum value of the force applied to cord 44 is equivalent to a load of between 25 and 75 kilograms being suspended from one end of cord 44. The braking force is described as "substantial" in that controller arrangement 84 provides a non-substantial braking force to cord 44 even before the force applied on cord 44 exceeds a minimum value due to frictional effects of the pulleys and rollers of controller arrangement 84. Lever arrangement 114 includes a lever 124 and a connecting member 126, a slotted bridging member 128, a slotted plate 130 and a tapered track 132 (FIG. 8) including two side members 134. One end of lever 124 is mechanically connected to lower housing 100. The other end of lever 124 is mechanically connected to pulley 120. One end of connecting member 126 is mechanically connected to the middle section of lever 124. The other end of connecting member 126 is mechanically connected to the middle section of slotted bridging member 128. Optionally, the middle section of lever 124 is mechanically connected, directly, to the middle section of slotted bridging member 128, thereby making connecting member 126 redundant, as shown in FIG. 8. Tapered track 132 is mechanically connected to lower housing 100. Tapered track 132 is configured to guide gripping members 110 between side members 134. When gripping members 110 are at one end of tapered track 132, gripping members 110 do not touch cord 44. When gripping members 110 are at the other end of tapered track 132, gripping members 110 provide a substantial braking force to cord 44. Each gripping member 110 has a rod 136 disposed thereon. Slotted plate 130 has two slots 138 therein which converge at one end of slotted plate 130. Slotted bridging member 128 has two slots 140. Rod 136 of one gripping member 110 passes through one slot 138 and one slot 140. Similarly, rod 136 of the other gripping member 110 passes through the other of slots 138 and the other of slots 140. Slotted plate 130 is mechanically connected to tapered track 132, typically by bolts. Slotted plate 130 and slotted bridging member 128 are configured such that, when pulley 120 is pulled down by cord 44, lever 124 is rotated thereby pushing connecting member 126 which in turn pushes slotted bridging member 128, slotted bridging member 128 in turn pushing gripping members 110 together to grip cord 44.

Figure 9:
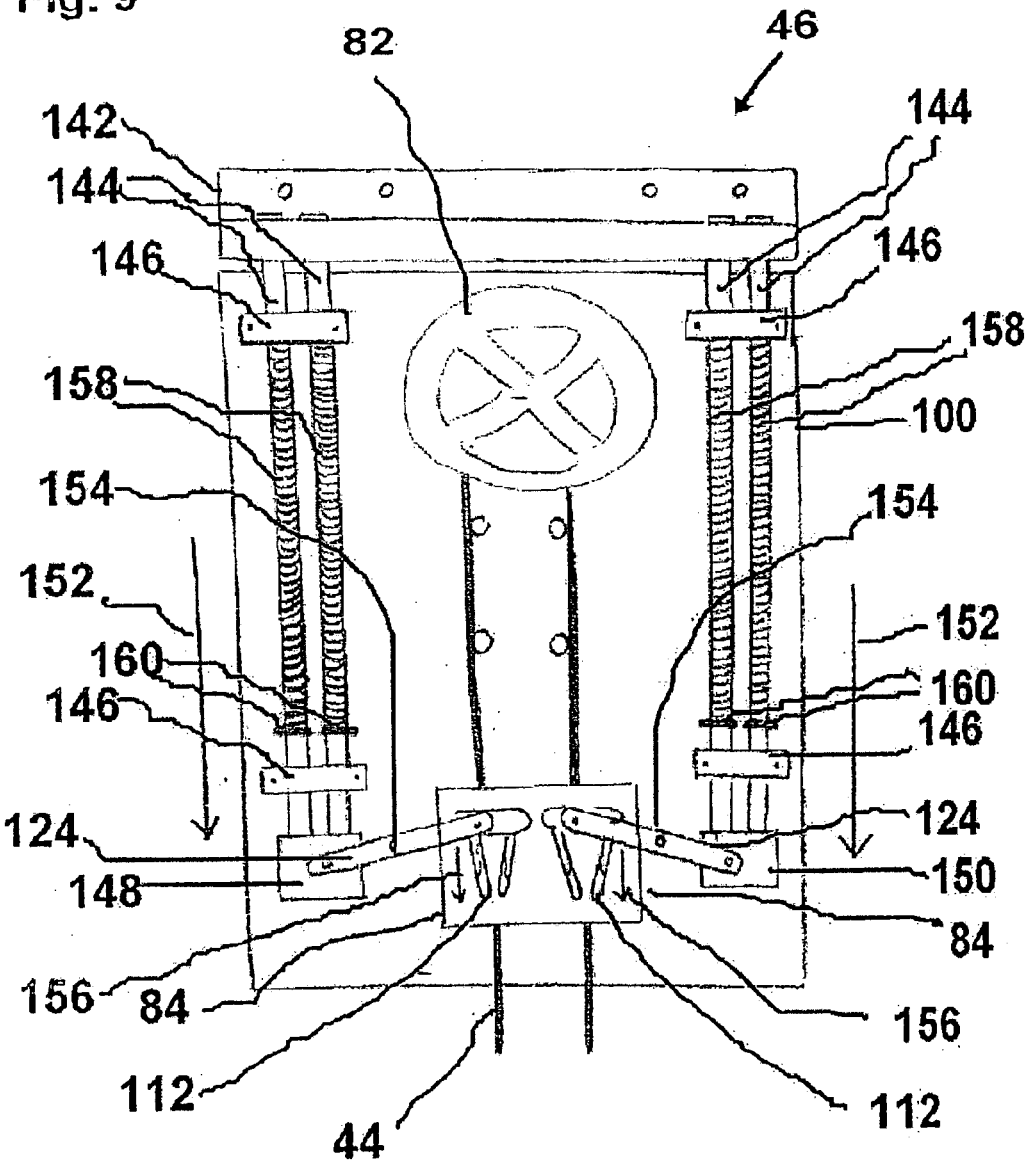
FIG. 9 is a plan view of a release mechanism of the emergency escape system of FIG. 2 that is constructed and operable in accordance with a most preferred embodiment of the present invention.

Reference is now made to FIG. 9, which is a plan view of release mechanism 46 of emergency escape system 12 of FIG. 2 that is constructed and operable in accordance with a most preferred embodiment of the present invention. In accordance with this most preferred embodiment, pulley 116, rollers 118, pulley 120 and connecting member 126 are not used. Cord 44 passes between grip surfaces 112 of one controller arrangement 84. Then, cord 44 partially circumscribes pulley 88 (FIG. 6) of controller arrangement 82. Then, cord 44 passes between grip surfaces 112 of the other controller arrangement 84. This most preferred embodiment involves less friction between controller arrangement 84 and cord 44 as pulley 116, rollers 118 and pulley 120 are not used. In accordance with this most preferred embodiment, a top mounting plate 142 is mechanically connected to door 14. Top mounting plate 142 is mechanically connected to lower housing 100 by four tubes 144 and four connecting members 146. There are two tubes 144 disposed on each side of controller arrangement 82. The top ends of tubes 144 are mechanically connected to top mounting plate 142. Connecting members 146 are mechanically connected to lower housing 100. Connecting members 146 have holes through which tubes 144 are configured to slide. Each connecting member 146 is configured to mechanically connect each pair of two tubes 144 to lower housing 100. Therefore, tubes 144 are mechanically connected to lower housing 100 via connecting members 146. Therefore, tubes 144 and connecting members 146 define the relative movement of lower housing 100 with respect to top mounting plate 142. Lower housing 100 is not fixed with respect to door 14. One pair of tubes 144 is mechanically connected to lever 124 of one controller arrangement 84 via a joining element 148. The other pair of tubes 144 is mechanically connected to lever 124 of the other controller arrangement 84 via a joining element 150. Each lever 124 is pivotably connected to lower housing 100 by a pivot 154. Each tube 144 has a spring 158 a spring stopper 160. One spring 158 is disposed around each tube 144 between spring stopper 160 and connecting member 146, which is closest to top mounting plate 142. When lower housing 100 is moved away from top mounting plate 142, connecting members 146, which are closest to top mounting plate 142, compress springs 158 against spring stoppers 160. Therefore, springs 158 are configured to enable lower housing 100 to be separated from top mounting plate 142 only when a minimal force or more is applied to lower housing 100. Optionally, each spring stopper 160 is configured as a bolt and each tube 144 includes a screw thread thereon, such that, the location of each spring stopper 160 is adjustable, thereby enabling adjustment of the minimum force required to compress springs 158. When a force, typically above a minimum force, is applied to one end of cord 44, cord 44 applies a force on pulley 88 of controller arrangement 82 thereby causing springs 158 to compress allowing lower housing 100 to move away from top mounting plate 142. This movement is shown by arrows 152. As tubes 144 are mechanically connected to top mounting plate 142, joining element 148 and joining element 150 move in an opposite direction to arrow 152 with respect to lower housing 100, thereby turning levers 124, which in turn cause grip surfaces 112 of both controller arrangements 84 to grip cord 44. The movement of levers 124 is shown by arrows 156. It should be noted that in accordance with this most preferred embodiment both controller arrangements 84 apply a breaking force to cord 44 at the same time.

It will be appreciated by persons skilled in the art that the present invention is not limited to what has been particularly shown and described hereinabove. Rather, the scope of the present invention includes both combinations and subcombinations of the various features described hereinabove, as well as variations and modifications thereof that are not in the prior art which would occur to persons skilled in the art upon reading the foregoing description.

What is claimed is:

1. An emergency escape system for escaping from a building, the building including an opening for human passage, the system comprising:

(a) an escape apparatus including a cord, said escape apparatus including a release mechanism configured for controlling the rate of movement of said cord having a person suspended thereon, thereby providing a controlled lowering of said person being lowered on said cord; and (b) a hollow door configured for installation in the opening for human passage, said door having substantially enclosed internal volume storing said escape apparatus within said substantially enclosed internal volume of said hollow door, said door being configured to allow access to said escape apparatus stored within said internal volume.

2. The system of claim 1, wherein said door is configured for fitting in the building using at least one hinge such that, when fitted in the building, said door is able to swing horizontally.

3. The system of claim 1, wherein said door is reinforced.

4. The system of claim 1, wherein said escape apparatus includes a storage arrangement configured to store said cord.

5. The system of claim 4, wherein said storage arrangement includes a spool.

6. The system of claim 4, wherein said storage arrangement includes at least one holder configured to connect said cord to said door, said at least one holder being sufficiently strong that said cord is maintained connected to said door when said cord is not in use and when said cord is needed, said cord is easily released from said door.

7. The system of claim 1, wherein said cord is inflammable.

8. The system of claim 1, wherein said release mechanism includes a first controller arrangement configured to apply a braking force as a function of the speed of movement of said cord to limit the speed of movement of said cord to a first speed.

9. The system of claim 8, wherein said first controller arrangement includes a pulley and an expandable braking arrangement, said pulley being configured such that, the cord at least partially circumscribes said pulley, said first controller arrangement being configured such that, as the speed of the cord increases, the expandable braking arrangement expands thereby applying a braking force for slowing down said pulley.

10. The system of claim 8, wherein said release mechanism includes a fail safe locking device being configured to stop movement of said cord when the speed of said cord exceeds a second speed being greater than said first speed.

11. The system of claim 8, wherein said release mechanism includes a second controller arrangement configured to apply a substantial braking force as a function of a force applied by said person to said cord.

12. The system of claim 11, wherein said second controller arrangement includes at least two grip surfaces, said grip surfaces being configured to apply said braking force to at least part of said cord.

13. The system of claim 12, wherein said second controller arrangement includes a lever arrangement mechanically interacting with said cord, said lever arrangement being configured to actuate said grip surfaces to apply said substantial braking force to at least part of said cord.

14. The system of claim 1, wherein said escape apparatus includes at least one harness, said harness being configured for connection to said cord.

15. The system of claim 1, wherein said escape apparatus is configured for a substantially continuous multiple use during a single evacuation.

16. A system for controlling movement of a cord having a force applied thereon, comprising:

(a) a first controller arrangement configured to apply a braking force as a function of the speed of movement of the cord; and (b) a second controller arrangement configured to apply a substantial braking force as a function of the force applied to the cord, wherein said second controller arrangement includes at least two grip surfaces, said grip surfaces being configured to apply said substantial braking force to at least part of the cord.

17. The system of claim 16, wherein said first controller arrangement includes a pulley and an expandable braking arrangement, said pulley being configured such that, the cord at least partially circumscribes said pulley, said first controller arrangement being configured such that, as the speed of the cord increases, the expandable braking arrangement expands thereby applying a braking force for slowing down said pulley.

18. The system of claim 16, wherein said first controller arrangement is configured to limit the speed of movement of the cord to a first speed.

19. The system of claim 18, further comprising a fail safe locking device being configured to stop movement of the cord when the speed of the cord exceeds a second speed being greater than said first speed.

20. The system of claim 16 wherein said second controller arrangement includes a lever arrangement mechanically interacting with the cord, said lever arrangement being configured to actuate said grip surfaces to apply said substantial braking force to at least part of the cord.

21. A system for controlling movement of a cord having a force applied thereon, comprising:

(a) a first controller arrangement configured to apply a braking force as a function of the speed of movement of the cord to limit the speed of movement of the cord to a first speed; and (b) a fail safe locking device being configured to stop movement of the cord when the speed of the cord exceeds a second speed being greater than said first speed, said fail safe locking device including a spring loaded arm and a notch, said fail safe locking device being configured such that, said spring loaded arm engages with said notch when the cord exceeds said second speed, thereby stopping movement of the cord.

22. The system of claim 21, wherein said first controller arrangement includes a pulley and an expandable braking arrangement, said pulley being configured such that, the cord at least partially circumscribes said pulley, said first controller arrangement being configured such that, as the speed of the cord increases, the expandable braking arrangement expands thereby applying a braking force for slowing down said pulley.

23. A system for controlling movement of a cord having a force applied thereon, comprising:

(a) a controller arrangement configured to apply a substantial braking force as a function of the force applied to the cord, wherein said controller arrangement includes at least two grip surfaces, said grip surfaces being configured to apply said substantial braking force to at least part of the cord; and (b) a fail-safe locking device being configured to stop movement of the cord when the speed of the cord exceeds a speed.

24. The system of claim 23, wherein said controller arrangement includes a lever arrangement mechanically interacting with the cord, said lever arrangement being configured to actuate said grip surfaces to apply said substantial braking force to at least part of the cord.

* * * * *